US006145234A

United States Patent [19]

Fluhr

[11] Patent Number: 6,145,234

[45] Date of Patent: Nov. 14, 2000

[54] FIRING PIN SAFETY CATCH MECHANISM

[75] Inventor: Norbert Fluhr, Oberndorf/Neckar, Germany

[73] Assignee: Heckler & Koch GmbH, Oberndorf/Neckar, Germany

[21] Appl. No.: 09/358,189

[22] Filed: Jul. 21, 1999

Related U.S. Application Data

[63] Continuation of application No. PCT/EP98/00376, Jan. 23, 1998.

[30] Foreign Application Priority Data

Jan. 23, 1997 [DE] Germany ..... 197 02 374

[51] Int. Cl.[7] ..... F41A 17/64

[52] U.S. Cl. ..... 42/70.08; 42/25; 42/69.03

[58] Field of Search ..... 42/70.08, 25, 69.03

[56] References Cited

U.S. PATENT DOCUMENTS

| | | | |
|---|---|---|---|
| 891,510 | 6/1908 | Tansley | 42/70.08 |
| 2,479,844 | 8/1949 | Koucky et al. | 42/25 |
| 2,712,192 | 7/1955 | Dixon et al. | 42/25 |
| 2,848,832 | 8/1958 | Lee | 42/70.08 |
| 4,352,317 | 10/1982 | Wilhelm | 42/70.08 |

FOREIGN PATENT DOCUMENTS

| | | | |
|---|---|---|---|
| 2 266 138 | 10/1975 | France . | |
| 69995 | 7/1893 | Germany . | |
| 313011 | 6/1919 | Germany . | |
| 304280 | 3/1920 | Germany | 42/70.08 |
| 319321 | 3/1920 | Germany | 42/70.08 |
| 334448 | 3/1921 | Germany . | |
| 546894 | 3/1932 | Germany | 42/25 |
| 338381 | 6/1959 | Switzerland | 42/70.08 |

OTHER PUBLICATIONS

PCT *International Search Report* dated Jun. 19, 1997 regarding PCT Patent Application Ser. No. PCT/EP98/00376.

*Primary Examiner*—Stephen M. Johnson
*Attorney, Agent, or Firm*—Marshall, O'Toole, Gerstein, Murray & Borun

[57] ABSTRACT

A firing pin safety catch mechanism for use with a firearm is disclosed. The safety catch mechanism includes a one-piece leaf spring comprising a spring arm, a safety catch and a beveled release part. The safety catch has a first position wherein the safety catch engages a catch surface of a firing pin to secure the firing pin in a rest position and a second position wherein the safety catch disengages the catch surface to release the firing pin for movement out of the rest position. The beveled release part is disposed adjacent the proximal end of the spring arm. It includes a camming surface disposed within the motion path of a hammer when the safety catch is in the first position such that, as the hammer moves to strike the firing pin, the hammer cams the camming surface of the beveled release part against the force of the spring arm to move the safety catch from the first position to the second position, and the hammer then strikes the proximal end of the firing pin to displace the firing pin from the rest position.

21 Claims, 2 Drawing Sheets

REST POSITION
HAMMER
5
21
35
33
13
31
29
11
15
A3
17
16
7
19
1
25
A2
23
9
A1
27
3

SECURE DURING FALL
HAMMER
5
31
11
R
16
25
3

FIRING PIN SAFETY CATCH MECHANISM

RELATED APPLICATION

This application is a continuation of International Patent Application Ser. No. PCT/EP98/00376 which was filed on Jan. 23, 1998.

FIELD OF THE INVENTION

The invention relates generally to firearms, and, more particularly, to a firing pin safety catch mechanism for preventing accidental discharge of a cartridge by a firearm.

BACKGROUND OF THE INVENTION

Numerous firing pin safety mechanisms have been proposed for decades (see, for example, DE 304 280, DE 319 321, U.S. Pat. No. 2,848,832, DE 313 011 and DE 69 995). Such known mechanisms have the general purpose of preventing undesired discharge of a shot if a weapon is violently struck from the front (for example, if its muzzle is struck on the ground when the weapon inadvertently falls from a balcony).

So-called "floating" firing pins, (that is, a firing pin having a tip which, when the firing pin is in the rest position, does not sit on the percussion cap of a cartridge, but instead is separated a distance from the cartridge by a weak spring that forces the pin in a rearward direction), are commonly used in firearms. When a hammer strikes the rear end of such a floating firing pin ("front" is understood throughout this document to mean the direction of shooting and "rear" is understood to be opposite "front"), kinetic energy is transferred to the firing pin which responds by moving forward through the separation distance and striking the percussion cap of the cartridge.

However, kinetic energy can also be imparted to a floating firing pin by an accident, a mishap or the like, (for example, when a weapon falls from a stairway, from a raised height, etc.). By way of another example, if the butt of a weapon having a muzzle facing in a downward direction strikes the edge of a wall hard, kinetic energy will be imparted to the firing pin which will then move forward and strike against the percussion cap of the cartridge, just as it would during shooting. This movement of the firing pin can cause the weapon to discharge. If the muzzle encounters, for example, a stone floor when this inadvertent discharge occurs, the muzzle can be additionally widened or otherwise deformed by the firing shock so that the weapon is severely damaged.

Some of the aforementioned patents, therefore, propose a catch-like safety element mounted to pivot around a cross pin in the breechblock. The proposed safety elements have a safety catch that faces the firing pin. The firing pin has a recess close to its rear end. The recess is located opposite the safety catch formed on the safety element. A coil or leaf spring loads the safety element so that the safety catch is forced into the recess. When the safety catch engages the recess, the firing pin is secured and cannot move toward the percussion cap even during one of the aforementioned accidents.

In some of the above mentioned safety elements, the safety element is lengthened rearward by a release part having a beveled or camming surface. The beveled surface of the release part extends into the motion path of the hammer directly behind the rear end of the firing pin. As a result, when the hammer strikes, it first strikes the beveled surface and, in so doing, forces the release part and, thus, the safety element to the side such that the firing pin is released by the safety catch before the pin is struck by the hammer. As a result, the firing pin can move under the influence of the hammer to fire a shot.

Although the above described firing pin safety mechanisms are effective, they have not gained acceptance, perhaps because of deficient reliability. Moreover, such mechanisms require several precision-machined individual parts; assembly of which is labor-intensive and, thus, impractical given the general cost pressure experienced by firearm manufacturers.

SUMMARY OF THE INVENTION

In accordance with an aspect of the invention, a firing pin safety catch mechanism is disclosed for use with a firearm having a breechblock and a trigger mechanism. The trigger mechanism includes a hammer, a firing pin and a firing pin spring. The hammer is movable from a loaded position through a motion path to strike the firing pin. The firing pin spring biases the firing pin into a rest position wherein a tip of the firing pin is spaced from a percussion cap of a cartridge disposed in front of the pin. The firing pin has a proximal end opposite the tip and a catch surface disposed in proximity to the proximal end. The firing pin safety catch mechanism comprises a one-piece leaf spring including a spring arm supported on the breechblock. It also includes a safety catch disposed in proximity to the proximal end of the spring arm and having a first position wherein the safety catch engages the catch surface to secure the firing pin in the rest position and a second position wherein the safety catch disengages the catch surface to release the firing pin for movement out of the rest position. The spring arm biases the safety catch into the first position. The leaf spring also includes a beveled release part disposed adjacent the proximal end of the spring arm. The beveled release part has a camming surface disposed within the motion path of the hammer when the safety catch is in the first position such that, as the hammer moves from the loaded position through the motion path, the hammer cams the camming surface of the beveled release part against the force of the spring arm to move the safety catch from the first position to the second position, and the hammer then strikes the proximal end of the firing pin to displace the firing pin from the rest position.

In accordance with another aspect of the invention, an apparatus is provided for use with a firearm having a hammer movable from a cocked position through a motion path to discharge a cartridge. The apparatus includes a breechblock having a first longitudinal bore and a second longitudinal bore. The first longitudinal bore is generally parallel to the second longitudinal bore. The apparatus also includes a firing pin disposed for reciprocating movement within the first longitudinal bore between a distal position and a proximal position. The firing pin has a proximal end and a distal end. The proximal end includes a catch surface. The apparatus also includes a firing pin spring cooperating with the firing pin to bias the firing pin toward the proximal position. Additionally, the apparatus is provided with a safety catch spring disposed within the second longitudinal bore. The safety catch spring has a distal end, a proximal end, and at least one spring arm disposed between the distal and proximal ends. The proximal end of the safety catch spring includes a safety catch positioned to selectively engage the catch surface of the firing pin to selectively secure the firing pin in the proximal position. The at least one spring arm biases the safety catch into engagement with the catch surface. The proximal end of the safety catch spring further includes a camming surface disposed within the motion path of the hammer such that, the hammer contacts the camming surface as the hammer moves from the cocked position through the motion path to disengage the safety catch from the catch surface to thereby release the firing pin for movement from the proximal position to the distal position.

Other features and advantages are inherent in the disclosed apparatus or will become apparent to those skilled in the art from the following detailed description and its accompanying drawings.

For better clarity, every element discussed in the following description is not labeled with a reference number in each of the figures. However, the reference numbers shown in any one of the figures apply to all the other figures.

DESCRIPTION OF THE PREFERRED EMBODIMENTS

Figure 1:
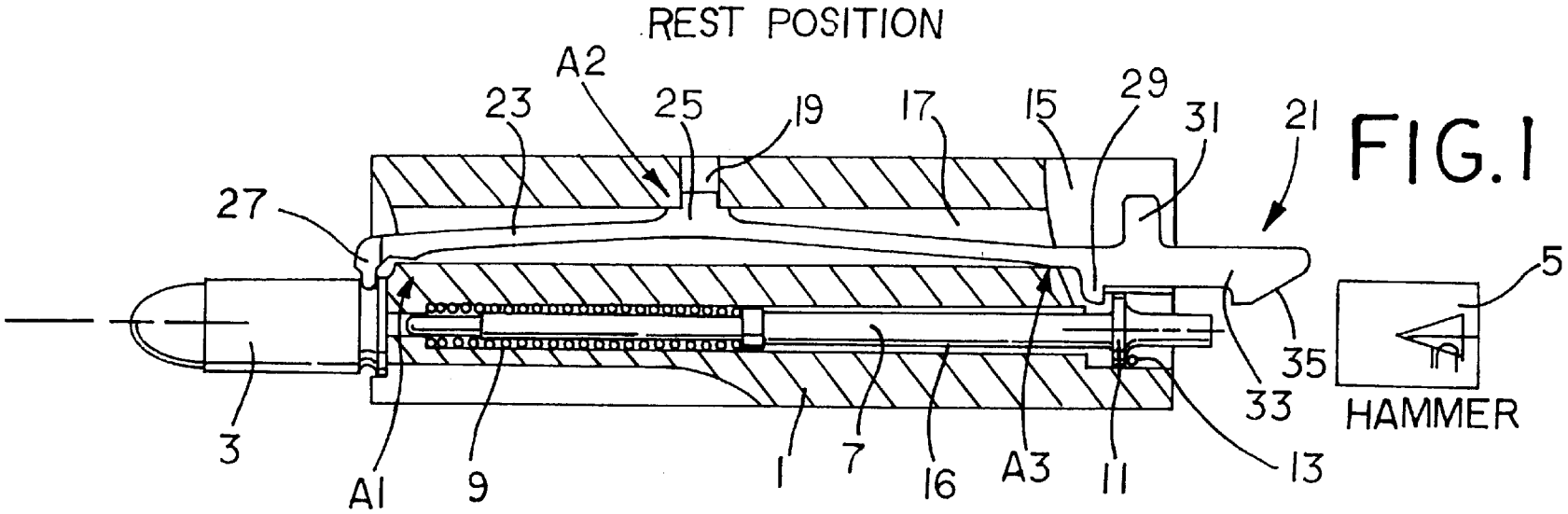
FIG. 1 is a longitudinal sectional view of a firing pin safety catch mechanism constructed in accordance with the teachings of the instant invention and shown in the rest position in a cocked and loaded weapon.

A firing pin safety catch mechanism constructed in accordance with the teachings of the invention is shown in FIG. 1 in an exemplary environment of use, namely, in the breech 1 of a firearm. The illustrated breechblock 1 has a recess on its front end. The bottom of a cartridge 3 sits in the recess. A hammer 5 is situated behind the recess. When a trigger (not shown) is operated to fire a shot, the hammer moves through a motion path from a cocked or loaded position (e.g., the position shown in FIGS. 1 and 2) to an uncocked or fired position (e.g., the position shown in FIG. 4).

Two longitudinal receiving holes or bores 16, 17 are formed in the breechblock 1. A firing pin 7 is located in a first one 16 of these bores between a cartridge 3 and the hammer 5 (i.e., the firing pin bore 16). The firing pin 7 is rearwardly biased into its rest position (FIG. 1) by a firing pin spring 9 mounted within the bore 16. The rest position is defined by the interaction of a band 11, which is positioned close to the rear end of the firing pin 7, and a cross pin 13 which is positioned within the breechblock 1. The band 11 is situated in a rear or proximal section of the bore 16. The proximal section of the firing pin bore 16 has a correspondingly larger diameter than the distal section of the bore or receiving hole 16. When the firing pin 7 is in the rest position, the rear or proximal end of the firing pin 7 protrudes from the breechblock 1 and extends into the motion path of the hammer 5. Additionally, when the firing pin 7 is in the rest position, the front or distal end of the firing pin 7 (i.e., its tip) is spaced within the firing pin bore 16 and, thus, is separated a distance from the percussion cap of the cartridge 3.

Figure 4:
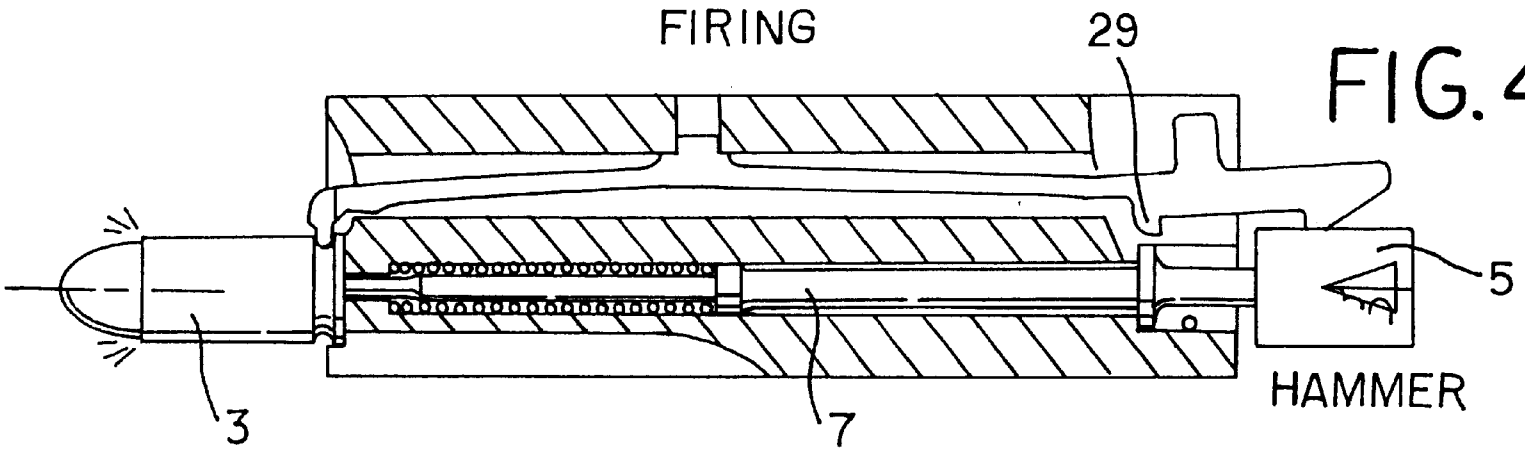
FIG. 4 is a view similar to FIG. 1, but showing the position of the mechanism during firing of a shot.

When the hammer 5 strikes the rear or proximal end of the firing pin 7, the firing pin 7 moves forward against the force of the firing pin spring 9 until the firing pin 7 strikes the percussion cap and fires the cartridge (FIG. 4).

As mentioned above, in the illustrated example, the firing pin 7 is a so-called "floating" firing pin, (i.e., it is shorter than the distance between the bottom of the cartridge 3 and the frontmost position of the hammer 5). As a result, the firing pin 7 does not serve as a stationary transfer element for transferring energy from the hammer 5 to the cartridge 3, but is instead moved by the hammer 5 so that it strikes the cartridge 3 with the kinetic energy the hammer 5 imparts to it.

As shown in FIG. 1, a guide groove 15 is milled into the rear end of the breechblock 1. The guide groove 15 is a narrow slit milled with a disk milling cutter, which starts from the side of the breechblock 1 and discharges into the end section of the proximal section of the firing pin bore 16.

The second longitudinal receiving bore or hole 17 (i.e., the "safety catch bore") extends through the breechblock 1 parallel to the firing pin hole 16. Both bores 16, 17 are open at both ends. Their distal ends open directly next to the breechblock. Their proximal ends open into the guide groove 15.

A transverse recess 19 communicates with the safety catch bore 17 at about the mid-point of the bore 17. The transverse recess 19 is open ended (i.e., it forms a channel completely through the wall of the breechblock 1 to the exterior).

A safety catch spring 21 is positioned within the safety catch bore 17. As shown in FIG. 1, the safety catch spring 21, which is preferably implemented as a one piece leaf spring, includes a proximal end that extends out of the safety catch bore 17 and into the guide groove 15. The proximal or rear end of the safety catch spring 21 forms a hook-like release part 33 that protrudes rearwardly from the breechblock 1. The release part 33 has a beveled camming surface 35 that extends increasingly into the motion path of the hammer 5 as one traverses the release part 33 from rear to front. The distal end of the release part 33 is positioned just to the side and behind the rear end of the firing pin 7.

The safety catch spring 21 also has a flat guide bracket or projection 31. The guide bracket 31 extends from the side of the safety catch spring 21 facing away from the firing pin 7 and into the guide groove 15 to ensure trouble-free guiding of the safety catch spring 21 within the guide groove 15 and to prevent twisting thereof.

The proximal end of the safety catch spring 21 also includes a safety catch 29. The safety catch 29 is positioned such that it can fall tightly behind the band 11 on the firing pin 7 when the firing pin 7 is in the rest position depicted in FIG. 1. To this end, the safety catch 29 extends from the side of the safety catch spring 21 facing the firing pin 7.

The distal or front end of the safety catch spring 21 extends out of the distal opening of the safety catch bore 17 and functions as an extractor claw 27. The extractor claw 27 is connected to the safety catch 29, the release part 33 with the beveled surface 35 and the guide bracket 31 by a weakly bent, curved spring arm 23. The spring arm 23 has a projection 25 located roughly on its apex. The projection 25 faces away from the firing pin 7 and engages in the transverse recess or hole 19.

The spring arm 23 is under spring tension between sites A1, A2 and A3 of the safety catch bore 17. Specifically, the side of the spring arm 23 facing the firing pin 7 lies against sites A1 and A3 on the ends of the safety catch bore 17. The side of the spring arm 23 facing away from the firing pin 7 lies against the inside wall of the safety catch bore 17 at the site A2 adjacent the transverse recess 19.

In the rest position depicted in FIG. 1, the extractor claw 27 engages in front of the bottom edge of the cartridge 3 and the safety catch 29 engages in front of the annular band 11 of the firing pin 7. The hammer 5 is cocked.

Figure 2:
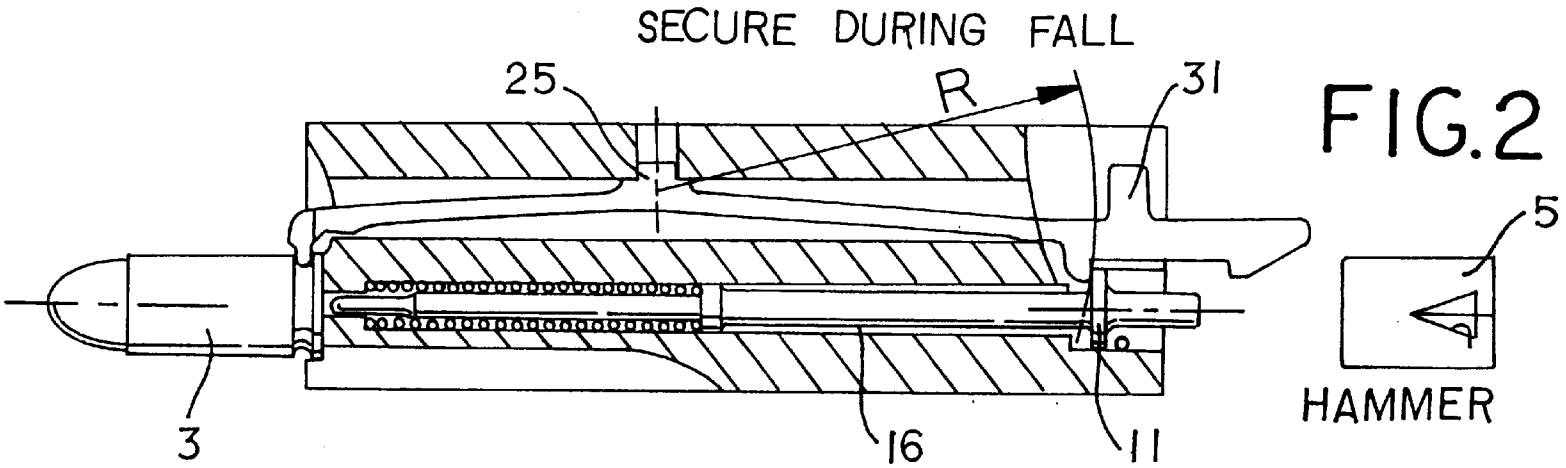
FIG. 2 is a view similar to FIG. 1, but showing the position of the mechanism when the firing pin is loaded forward by an external inertial force such as might be encountered when the weapon is dropped.

FIG. 2 shows an example in which an inertial force caused by an accident such as the weapon being dropped acts on the firing pin 7 and attempts to move it forward. When subjected to the inertial force, the annular band 11 presses against the safety catch 29. The motion path of the safety catch 29 runs along the radius R centered around the root of the rear section of the spring arm 23, which is positioned close to support point A2 (see FIG. 2). When the safety catch 29 follows this motion path, it engages more strongly behind the annular band 11. The more forcefully the annular band 11 attempts to move forward, the more strongly the safety catch 29 engages behind the band 11 and, thus, the more reliably the safety catch 29 secures the firing pin 7 against distal movement sufficient to discharge a shot. The tip of the firing pin 7, therefore, remains separated from the percussion cap of the cartridge 3.

Figure 3:
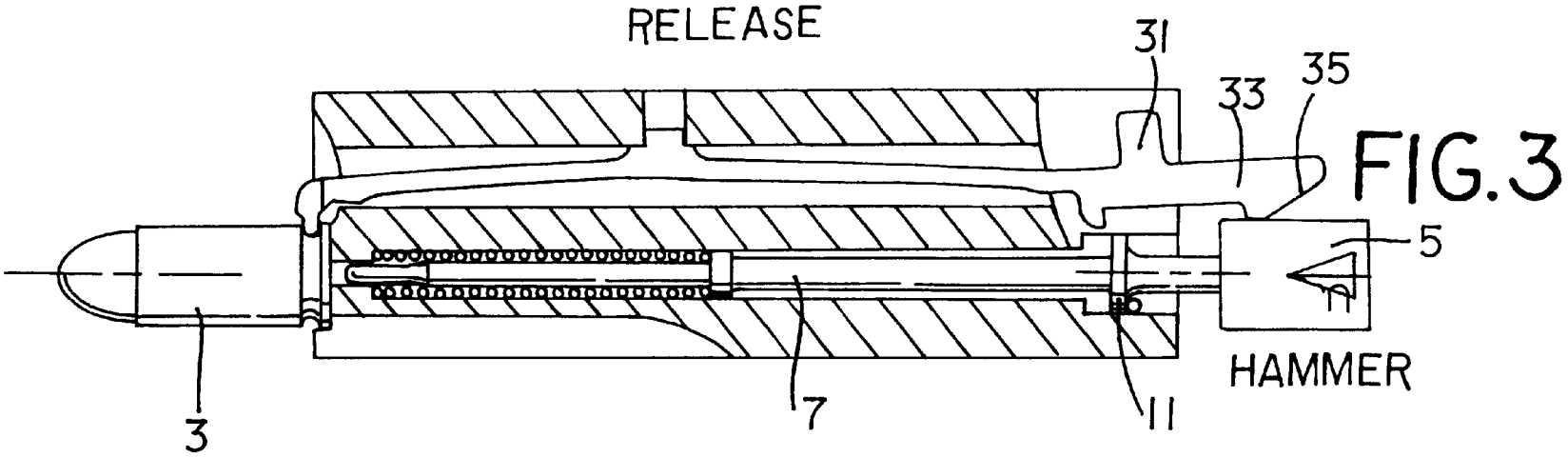
FIG. 3 is a view similar to FIG. 1, but showing the position of the mechanism immediately before the hammer strikes the firing pin.

If, as in the example shown in FIG. 3, the hammer 5 is released, the hammer 5 moves forward and encounters and runs along the beveled surface 35. When the hammer 5 runs along the beveled surface 35, it forces the release part 33 and, therefore, the safety catch 29 to the side against the spring action of the rear part of the spring arm 23. As a result, the annular band 11 and, thus, the firing pin 7 are released for distal movement. The release part 33 then lies with the front end of the beveled surface 35 laterally against the hammer 5 and remains so positioned during further forward movement of the hammer 5 so that the safety catch 29 remains situated in the release position (e.g., laterally displaced relative to the annular band 11).

The outer edge of the front surface of the annular band 11 and the rear edge of the safety catch 29 facing the firing pin 7 are each preferably provided with a chamfer or beveled surface (not shown). These beveled surfaces are complementary to each other. If, for example, because of a disturbance, the firing pin 7 is not moved entirely back into its rest position after a shot is discharged, the two beveled surfaces engage each other. The spring force generated by the spring arm 23 then forces the safety catch 29 against the firing pin 7 (i.e., forces the beveled surfaces against one another) with a force sufficient to cause the firing pin 7 to move rearward under the guiding influence of the beveled surfaces until the safety catch 29 fully engages behind the annular band 11.

FIG. 4 illustrates how, after the hammer 5 strikes the rear end of the firing pin 7, the firing pin 7 moves forward since the safety catch 29 remains in its release position. When the firing pin 7 strikes the cartridge, it is fired.

During reloading, the breechblock 1 pushes a new cartridge from the magazine (not shown) forward into a cartridge chamber (not shown) until it sits on its end. The front oblique surface of the extractor claw 27 facing the cartridge 3 now presses against the rear edge of the cartridge 3. The extractor claw 27 is forced to the side against the spring action of the front section of the spring arm 23, jumps over the edge of the cartridge, and engages the cartridge 3 as shown in FIGS. 1 to 4.

From the foregoing, persons of ordinary skill in the art will appreciate that the disclosed firing pin safety catch mechanism is advantageous with respect to known firing pin safety arrangements in that, for example, it employs fewer components and has higher operating reliability. These advantages are attained without any additional components and preferably with simple mechanical means which require the least possible machining. In particular, the disclosed apparatus achieves these objectives by implementing the safety element as a one-piece leaf spring 21 that includes a spring arm 23 which extends forward from the safety catch 29 and is supported in front of the rear end of the firing pin 7.

Known firing pin safety mechanisms include a safety catch which is rotatably mounted on a cross pin. In these mechanisms, the cross pins are very severely loaded by the striking of the hammer on the release part. Because of the limited assembly space, the cross pin cannot be designed strongly enough to withstand the loads indefinitely at reasonable expense. Therefore, these known mechanisms do not have long useful lives.

Not only are all components of the known firing pin safety mechanisms replaced by a single component in the disclosed apparatus (namely, the safety catch spring 21), but the critical cross pin is completely eliminated. The required mobility of the safety catch 29 is produced by locating it on the displaceable end of the spring arm 23. The front, fixed end of the spring arm 23 does not require a thin cross pin for rotatable mounting or support. Therefore, the safety catch spring 21 does not suffer from the problems associated with the cross pin design.

In order to permit particularly simple manufacture of the safety catch spring 21 that forms the safety catch 29 and the spring arm 23 in the disclosed mechanism, the safety catch spring 21 is preferably designed as a flat spring sheet part. Preferably, at least the proximal end of the safety catch spring 21 is guided in the guide groove 15. The flat safety catch spring 21 is not deflected across its plane, but rather, deflection occurs within its plane. Locating the safety catch spring 21 within the guide groove 15 prevents it from being bent out from its plane when loaded.

Positioning the safety catch 29 of the safety catch spring 21 within the groove or slit 15 in the breechblock of the weapon provides sufficient guiding for the leaf spring arm 23. As a result, the spring arm 23 can be arranged freely or in a simple hole.

In principle, it is possible to produce the safety catch spring 21 by machining from unhardened spring steel sheet, to harden it (which is understood also to mean the required tempering), and then to grind it. However, it is particularly advantageous to design the safety catch spring 21 as a hardened stamped part. The manufacturing costs for the safety catch spring 21 are, thus, very low. Grinding after hardening can be dispensed with, since the safety catch 29 and the beveled surface 35 need not exhibit either high precision or particular surface quality.

To further improve manufacture and to ensure greater reliability even when the weapon employing the disclosed firing pin safety catch mechanism experiences soiling, the safety catch spring 21 has a protruding guide bracket or projection 31 on its side facing away from the safety catch 29. This projection 31 improves the guiding function of the groove 15. The safety catch spring 21 is, therefore, widened overall in the region of the safety catch 29 and can, therefore, carry out its guide function adequately enough, even when the width of the receiving groove 15 is very amply tolerated. It is also possible to tolerate a slight distortion of the safety catch spring 21 occurring during hardening, because this safety catch spring 21 can still be accepted without disturbance by the amply tolerated guide groove 15 without requiring machining.

As mentioned above, the spring arm 23 is preferably lengthened beyond the front end of the firing pin 7 and the front end of the spring arm 23 functions as an extractor claw 27. Some prior art extractor claws have been implemented in one piece with a corresponding spring, but these intricately shaped milled parts, whose hardening was difficult, were so expensive and their mounting so costly that they have long been abandoned. Instead, the modem extractor claw is typically designed as a massive pivoting part loaded by a coil spring. This pivoting part, however, requires high machining cost and must be hardened and then ground.

By lengthening or elongating the safety catch spring 21 into an extractor claw 27 as disclosed herein, the previously required extractor spring is eliminated. The extractor claw 27 and firing pin safety catch 29 are formed from a single component whose front end is machined and can optionally be further finished after hardening, but these working steps are also required in the previous extractor claw. Thus, not only is no additional component necessary for implementing the firing pin safety catch mechanism, but a component is also eliminated on the extractor claw.

Preferably, the spring arm 23 is bent and sits in the safety catch hole 17 in the breechblock that opens at one end next to the front end of the firing pin 7 and, at the opposite end, immediately before the undercut or catch surface of the firing pin 7. As mentioned above, the spring arm 23 is preferably supported on the ends of the safety catch hole 17 on its side facing the firing pin 7 and has a projection 25 roughly in the center of the bend facing away from the firing pin 7. The projection 25 is mounted within a transverse recess 19 formed in the breechblock 1. The spring arm 23 is supported by spring action on the two ends of the safety catch hole 17 on one side and with its center region on the opposite side. Because of the spring tension, the projection 25 cannot be inadvertently loosened from the transverse recess 19.

During assembly, the safety catch 21 is pushed from the rear into the guide groove 15 and then into the safety catch hole 17 until the projection 25 snaps into the transverse recess 19. This operation can be carried out without a problem because the guide groove 15 aligns the safety catch spring 21 so that the projection 25 encounters the recess 19. The engagement of the projection 25 and the recess 19 as well as the guide groove 15 guarantee trouble-free alignment of the safety catch spring 21 within the safety catch bore 17. Deflection of the extractor claw 27 and/or the safety catch 29 forces the projection 25 even more strongly into the recess 19 so that reliable positioning of the safety catch spring 21 is guaranteed with low cost.

The longitudinal safety catch bore 17 in which the safety catch spring 21 resides additionally limits the possible deflection of the spring arm 23 and, thus, prevents it from being bent or broken by excessive deflection. Operational reliability is, therefore, guaranteed.

The fact that the transverse hole 19 that receives the projection 25 of the spring arm 23 and supports the spring arm 23 during deflection is relatively far removed in the transverse direction from the firing pin 7 is particularly important. Specifically, if the rear part of the spring arm 23 is deflected, the safety catch 29 is moved along a circular arc around the support point roughly at the center of the projection 25. Since the rear apex of this circular arc is displaced laterally toward the firing pin 7, when the safety catch is deflected to release the firing pin 7, it moves both laterally and rearwardly at the beginning of its deflection. Conversely, when the firing pin 7 applies a forwardly directed force to the safety catch 29, the safety catch 29 attempts to deflect in a direction toward the firing pin 7 so that the spring force enhances the engagement of the safety catch 29 and the firing pin 7 when an inertial force that loads the firing pin forward occurs. The higher the forwardly directed force acting on the firing pin 7, the more firmly the safety catch 29 is forced into engagement with the firing pin 7. Thus, superimposed additional inertial forces, which could occur, for example, if the weapon bounces down a stairway from step to step, cannot deactivate the disclosed firing pin safety catch mechanism.

The transverse recess 19 is open to the outside of the breechblock 1. The safety catch spring 21 can, therefore, be removed by forcing a punch or the like from the outside into the transverse recess 19 to push back the projection 25, by then bending back the extractor claw 27 and by pulling the safety catch spring 21 rearwardly out of the safety catch bore 17. Disassembly of the disclosed firing pin safety catch mechanism can, therefore, be carried out in a straightforward manner without use of a special tool. Disassembly may be useful, for example, during reconditioning of the weapon, reburnishing of the breechblock, etc.

Although persons of ordinary skill in the art will readily appreciate that the firing pin 7 can be provided with an annular groove for interacting with a safety catch as can be found in the prior art mentioned in the introduction, in the disclosed mechanism the firing pin 7 is provided with an annular band 11, (i.e., a projection that protrudes over the essentially cylindrical surface of the firing pin 7). Employing the annular band 11 makes it possible to employ an overall thinner and lighter firing pin 7. Additionally, the rear protruding surface of the annular band 11 can be used as a stop surface to define the rest position of the firing pin 7. The annular band 11 is preferably guided with limited play in a widened section of the firing pin bore 16 for the firing pin 7 so that support of the firing pin 7 is provided opposite the safety catch 29 such that deflection of the firing pin 7 by the safety catch 29 is made impossible.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. A firearm comprising:

a breechblock;

a firing pin having a tip, a proximal end opposite the tip and a catch surface disposed in proximity to the proximal end;

a hammer which is movable from a loaded position through a motion path to strike the firing pin;

a firing pin spring biasing the firing pin into a rest position wherein the tip of the firing pin is adapted to be spaced from a percussion cap of a cartridge; and a one-piece leaf spring including: (a) a spring arm supported on the breechblock, the spring arm having a proximal end; (b) a safety catch disposed in proximity to the proximal end of the spring arm and having a first position wherein the safety catch engages the catch surface to secure the firing pin in the rest position and a second position wherein the safety catch disengages the catch surface to release the firing pin for movement out of the rest position, the spring arm biasing the safety catch into the first position; and (c) a beveled release part disposed adjacent the proximal end of the spring arm, the beveled release part having a camming surface disposed within the motion path of the hammer when the safety catch is in the first position such that, as the hammer moves from the loaded position through the motion path, the hammer cams the camming surface of the beveled release part against the force of the spring arm to move the safety catch from the first position to the second position, and the hammer then strikes the proximal end of the firing pin to displace the firing pin from the rest position.

2. A firearm as defined in claim 1 wherein the leaf spring comprises a generally flat sheet part that is guided within a guide groove formed in the breechblock.

3. A firearm as defined in claim 2 wherein the sheet part comprises a hardened stamped part.

4. A firearm as defined in claim 1 wherein the leaf spring further comprises a projection mounted within a guide groove formed in the breechblock, the projection being disposed in proximity to the proximal end of the spring arm.

5. A firearm as defined in claim 4 wherein the projection is disposed on a first side of the leaf spring and the safety catch is disposed on a second side of the leaf spring, the first side being opposite the second side.

6. A firearm as defined in claim 1 wherein the spring arm further comprises a distal end located beyond the tip of the firing pin, and the distal end of the spring arm comprises an extractor claw.

7. A firearm as defined in claim 6 wherein the breechblock defines a first longitudinal bore and a second longitudinal bore, the first and second longitudinal bores being generally parallel, the firing pin being disposed in the first longitudinal bore and the leaf spring being disposed in the second longitudinal bore.

8. A firearm as defined in claim 7 wherein the second longitudinal bore includes a recess, the spring arm defines a bend between the distal end and the proximal end, the spring arm includes a projection in proximity to the bend, the projection faces away from the firing pin, and the projection is disposed at least partially within the recess.

9. A firearm as defined in claim 8 wherein the second longitudinal bore has a first end and a second end, and the spring arm is supported against the first and second ends.

10. A firearm as defined in claim 8 wherein the recess is disposed transverse to the second longitudinal bore, and the recess passes completely through a wall of the breechblock.

11. A firearm as defined in claim 1 wherein the catch surface of the firing pin is part of an annular band near the proximal end of the firing pin.

12. A firearm as defined in claim 11 wherein the annular band has a front, outer peripheral edge having a chamfer, and the safety catch has a rear edge facing the front, outer peripheral edge of the annular band, the rear edge being beveled.

13. For use with a firearm, an apparatus comprising:

a breechblock having a first longitudinal bore and a second longitudinal bore, the first longitudinal bore being generally parallel to the second longitudinal bore;

a hammer movable from a cocked position through a motion path;

a firing pin disposed for reciprocating movement within the first longitudinal bore between a distal position and a proximal position, the firing pin having a proximal end and a distal end, the proximal end including a catch surface;

a firing pin spring cooperating with the firing pin to bias the firing pin toward the proximal position; and a safety catch spring disposed within the second longitudinal bore, the safety catch spring having a distal end, a proximal end, and at least one spring arm disposed between the distal and proximal ends, the proximal end of the safety catch spring including a safety catch positioned to selectively engage the catch surface of the firing pin to selectively secure the firing pin in the proximal position, the at least one spring arm biasing the safety catch into engagement with the catch surface, the proximal end of the safety catch spring further including a camming surface disposed within the motion path of the hammer such that, the hammer contacts the camming surface as the hammer moves from the cocked position through the motion path to disengage the safety catch from the catch surface to thereby release the firing pin for movement from the proximal position to the distal position.

14. An apparatus as defined in claim 13 wherein the safety catch spring comprises a one piece leaf spring.

15. An apparatus as defined in claim 13 wherein the safety catch spring further comprises a projection mounted within a guide groove formed in the breechblock, the projection being disposed in proximity to the proximal end of the safety catch spring.

16. An apparatus as defined in claim 13 wherein the distal end of the safety catch spring is located beyond the tip of the firing pin, and the distal end of the safety catch spring comprises an extractor claw.

17. An apparatus as defined in claim 13 wherein the second longitudinal bore includes a recess, the safety catch spring defines a bend between the distal end and the proximal end, the safety catch spring includes a projection in proximity to the bend, the projection faces away from the firing pin, and the projection is disposed at least partially within the recess.

18. An apparatus as defined in claim 17 wherein the second longitudinal bore has a first end and a second end, and the safety catch spring is supported against the first and second ends.

19. An apparatus as defined in claim 17 wherein the recess is disposed transverse to the second longitudinal bore, and the recess passes completely through a wall of the breechblock.

20. An apparatus as defined in claim 13 wherein the catch surface of the firing pin is part of an annular band near the proximal end of the firing pin.

21. An apparatus as defined in claim 20 wherein the annular band has a front, outer peripheral edge having a chamfer, and the safety catch has a rear edge facing the front, outer peripheral edge of the annular band, the rear edge being beveled.

* * * * *